United States Patent [19]

Kameyama et al.

[11] Patent Number: 4,629,172

[45] Date of Patent: Dec. 16, 1986

[54] IMAGE FORMING APPARATUS

[75] Inventors: Toru Kameyama, Tokyo; Junichi Asano, Hoya, both of Japan

[73] Assignee: Canon Kabushiki Kaisha, Tokyo, Japan

[21] Appl. No.: 648,955

[22] Filed: Sep. 10, 1984

[30] Foreign Application Priority Data

Sep. 14, 1983 [JP] Japan ..... 58-168433

[51] Int. Cl.[4] ..... B65H 5/26

[52] U.S. Cl. ..... 271/9; 270/58; 198/448; 271/270; 271/265

[58] Field of Search ..... 271/9, 270, 265, 272, 271/202, 203; 270/58; 198/448, 449, 357

[56] References Cited

U.S. PATENT DOCUMENTS

| | | | |
|---|---|---|---|
| 3,693,486 | 9/1972 | Maniaci et al. | 198/448 |
| 3,948,510 | 4/1976 | Iwamoto et al. | 271/258 |
| 4,341,334 | 7/1982 | Bier | 271/203 |

*Primary Examiner*—George E. A. Halvosa
*Assistant Examiner*—James E. Barlow
*Attorney, Agent, or Firm*—Fitzpatrick, Cella, Harper & Scinto

[57] ABSTRACT

Disclosed is a sheet material feeding device which has a first row of sheet materials comprising a number of sheet materials moved in the direction of arrangement and provided in the form of a row and a second row of sheet materials disposed in proximity to the first row of sheet materials and which is for converging these two rows of sheet materials into a single row of sheet materials. Accelerating apparatus is disposed in the first row of sheet materials and at this position, a sheet material of the first row of sheet materials is moved at a higher speed than the succeeding sheet material to thereby enlarge the interval between the two sheet materials, and accelerating apparatus for feeding a sheet material of the second row of sheet materials into the enlarged interval is disposed in the second row of sheet materials.

5 Claims, 6 Drawing Figures

(a)

(b)

IMAGE FORMING APPARATUS

BACKGROUND OF THE INVENTION

1. Field of the Invention

This invention relates to a sheet material feeding device suitable for use in an image recording apparatus such as a copying machine or a printer, and more particularly to a sheet material feeding device for converging two rows of sheet materials into a single row of sheet materials to thereby enhance the speed of sheet conveyance.

2. Description of the Prior Art

For example, sheet material feeding and processing means is known which is provided with at least two image recording mechanism portions and in which sheet materials processed independently of one another or in connection with one another in the respective mechanism portions are piled at a predetermined position individually or correlatively in a desired order.

By reference to FIG. 1 of the accompanying drawings which illustrates a copying machine provided with two image recording mechanism portions using the electrostatic photographic process, the processing of sheet materials in such type of image recording apparatus will hereinafter be described briefly.

In FIG. 1, reference numerals 1 and 2 designate image forming portions including photosensitive drums D1 and D2, respectively, and it is to be understood that transfer paper sheets successively supplied from transfer paper supply sources F1 and F2 are fed along paths a, b, c, . . . , k, 1 in a conventional manner, as will hereinafter be described, and receive the images in the image forming portions and are discharged into stackers S1 and S2.

In such a copying machine, it is possible to accomplish copying at a speed double that of copying machines individually having individual image forming portions 1 and 2, by the use of the two paths designated by the reference characters a, b, c, d, f, g and h, i, j, k, l, g in FIG. 1 which indicate the directions of movement of the transfer materials.

That is, the transfer paper sheets supplied from the supply source F1 are moved generally along a, b, c, d and copying thereon is effected by the image forming portion 1, and finished copies are discharged into the stacker S2 via the path f, g by a discharge control portion 3 for sheet materials such as transfer paper sheets, and with a suitable timing with respect to the above-described copying process, transfer paper sheets are supplied from the supply source F2 and are moved along the path h, i, j, k and copying thereon is effected by the image forming portion 2, and finished copies are discharged into the stacker S2 via the path 1, g by the discharge control portion 3 and are superposed on the transfer paper sheets supplied from the supply source F1.

What has been described above shows the means (double speed mode) for operating two copying machines of relatively low speed in a mutually associated manner and accomplishing copying substantially at a speed double that of each copying machine, and of course, such copying machine is not restricted to such an operation mode but may also be operated in other modes.

That is, the copying machine can be operated in a manner (independent mode) in which the image forming portions 1 and 2 are operated independently of each other or only one of them is operated and the transfer paper sheets supplied from the supply source F1 are superposed one upon another in the stacker S1 through the path a, b, c, the image forming portion 1 (the path c, d) and the path e, while the transfer paper sheets supplied from the supply source F2 are superposed one upon another in the stacker S2 via the image forming portion 2 (the path h, i) and the path j, k, l, g.

Also, the transfer paper sheets supplied from the supply source F2 may be discharged into one of the stackers S1 and S2 through the image forming portion 2 (the path h, i), the image forming portion 1 (the path c, d) and the path e or the path f, g, whereby there can be obtained a combination of images or two-color copies (multiplex mode).

Further, the transfer paper sheets supplied from the supply source F2 may be brought to the path j of the inverting portion 4 via the image forming portion 2 (the path h, i) and once stopped and then discharged from the inverting portion 4 into the stacker S1 or S2 via the image forming portion 1 (the path c, d) and the path e or the path f, g, whereby images can be formed on both sides of the transfer paper sheets (both-side mode).

As described above, the copying by each mode as described above can be accomplished by using two image forming portions, and it will be readily understood that as required, the supply sources F1, F2, the inverting portion 4, the discharge control portion 3, the stackers S1, S2, etc. may be made discrete from one another or may be suitably added or removed.

SUMMARY OF THE INVENTION

The present invention provides, in such an image recording apparatus, a high-speed sheet material feeding device designed such that, particularly when the apparatus is used in a double speed mode, sheet material accelerating means are disposed at predetermined regions, whereby sheet materials having images formed thereon by individual image forming portions are accurately superposed one upon another.

The major construction of the present invention consists in a sheet material feeding device which has a first row of sheet materials comprising a number of sheet materials moved in the direction of arrangement and provided in the form of a row and a second row of sheet materials disposed in proximity to the first row of sheet materials and which is for converging these two rows of sheet materials into a single row of sheet materials and in which accelerating means is disposed in the first row of sheet materials and at this position, a sheet material of the first row of sheet materials is moved at a higher speed than the succeeding sheet material to thereby enlarge the interval between the two sheet materials and accelerating means for feeding a sheet material of the second row of sheet materials into the enlarged interval is disposed in the second row of sheet materials.

The present invention which is provided with the above-described construction can make the interval between the adjacent sheets in each of a plurality of rows of sheet materials as small as possible, whereby when an instrument which moves each row at a low speed is substantially operated at a double or higher speed, the sheets in each row can be moved at as high a speed as possible and therefore, high-speed operation of the entire instrument can be made possible.

DESCRIPTION OF THE PREFERRED EMBODIMENT

Figure 1:
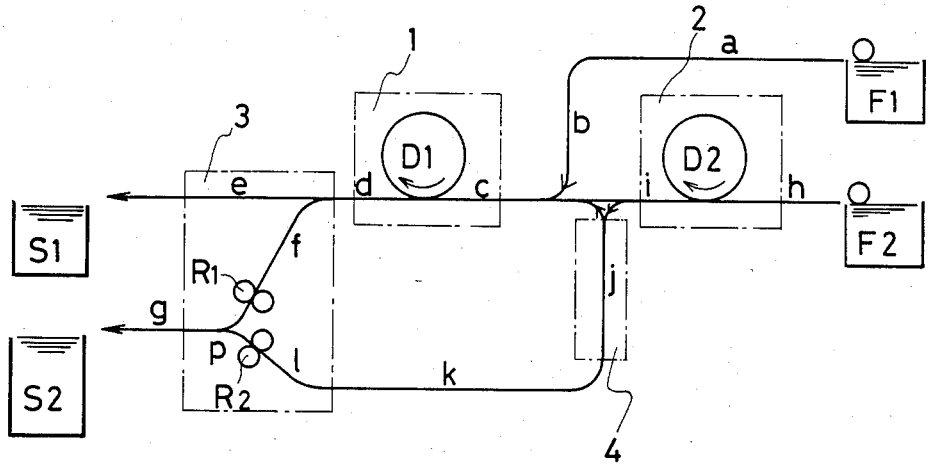
FIG. 1 illustrates the operation of an image recording apparatus capable of effecting various modes of operation to which the present invention is applied.

The present invention will hereinafter be described with respect to a copying apparatus shown in FIG. 1. The case of the double speed mode operation has been described previously and in FIG. 1, the direction of movement of transfer paper in such case is indicated by thick lines. The present invention is characterized in that at positions upstream of the junction P of two paths f and 1 in the transfer paper discharge control portion 3, pairs of rollers R1 and R2 are provided for accelerating the transfer paper sheets which have arrived at these paths.

By reference to FIGS. 2 and 3, description will hereinafter be made of the manner in which recorded paper sheets individually moving along the paths are all arranged in series by the use of the pairs of accelerating rollers R1 and R2 as described above.

Figure 2:
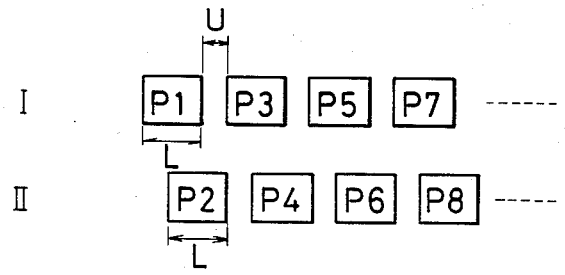
FIG. 2, 3(*a*) and (*b*) illustrate sheet material aligning means according to the present invention.

FIG. 2 shows the state in which finished copies P1, P3, P5, . . . and P2, P4, P6, . . . fed by respective image forming portions 1 and 2 are timeserially arranged. It is to be understood that in the image forming portion 1, the first page P1, the third page P3, the fifth page P5, . . . are prepared and in the image forming portion 2, the second page P2, the fourth page P4, the sixth page P6, . . . are prepared, and it is also to be understood that as to time, the pages P1, P2, P3, P4, . . . are alternately prepared in the named order by the image forming portions 1 and 2. It will be readily seen that to accelerate the copying speed as a whole, it is desirable to make the interval U between adjacent copies in copy rows I and II as small as possible, but if this is done, as will be seen from FIG. 2, the work by the image forming portion 2 will be initiated before the copying work in the image forming portion 1 is terminated, and the copies in the two rows will come while being partly superposed on one another and therefore, the transfer paper sheets on the downstream side of the aforementioned junction P will partly overlap each other and this will lead to the occurrence of an inconvenience in detection of jam and successive stacking treatment of the transfer paper sheets on a stacker S2.

In the present invention, to avoid such an inconvenience and enable copies to be successively stacked on the stacker S2 in accordance with the original order thereof, the pairs of accelerating conveyor rollers R1 and R2 are disposed upstream of the junction P (FIG. 1) of the paths f and 1 along which the copies in the rows I and II move, so that a copy is quickly conveyed to the downstream side of the pairs of rollers to thereby enlarge the interval between this copy and the succeeding copy and insert a copy in the other row into this interval.

Figure 3:
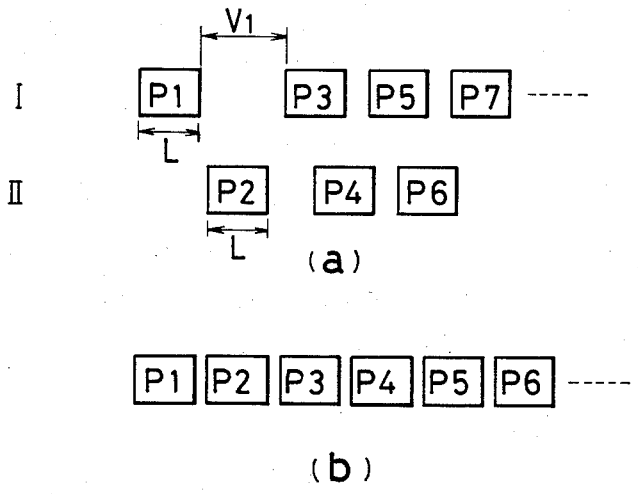

That is, as shown in FIG. 3(*a*), a copy P1 of the copy group in the row I is rapidly moved by the pair of accelerating rollers R1 to thereby enlarge the interval between the copy P1 and the succeeding copy P3 to U1 and at a point of time whereat this interval U1 becomes U1>L relative to the length L of the copy P2 in the row II in the direction of movement which is to be inserted after the copy P1, the copy P2 is accelerated by the pair of accelerating rollers R2 and the copy P2 is inserted into the interval U1 during the time until the succeeding copy P3 is accelerated, and then the copy P2 is conveyed into a common path g, and a similar operation is also effected between the copies P3 and P4, between the copies P5 and P6, . . . , whereby the copies P1, P2, P3, P4, P5, P6, . . . are serially aligned in a predetermined order as shown in FIG. 3(*b*) and therefore, these copies may be successively discharged into the stacker S2 while keeping this order.

In this case, due to the construction of the image forming portions 1 and 2, the copying speed of each row I, II in each path, and accordingly the interval U is constant and the length L as viewed in the direction of movement of each copy is generally definite and further, the interval U1 can also be suitably determined, and all of these can be converted into length and accordingly into time series and further, the speeds of the pairs of accelerating rollers R1 and R2 can also be determined so as to satisfy the values of these and therefore, it will be readily understood that by utilizing, for example, sequence means using a well-known clock pulse, two rows of copy groups can be aligned into a single row as previously described.

The accelerating means is not restricted to the pairs of accelerating rollers but a belt may also be used, and when changing the two rows of groups into a single row, it is also possible to insert copies in one row every several copies in the other row, to make the inserting row and the inserted row reverse to the case of the aforedescribed embodiment, and to stop the inserting row.

While the present invention has been described with respect to a copying machine provided with two image forming apparatuses, it is apparent that the present invention is not restricted to a copying machine but is equally applicable to a printer and other various image recording apparatuses and that the present invention is applicable not only to align two rows of sheet materials into a single row but also to align three or more rows of sheet materials into a single row and further, it will also be readily understood that the present invention can be applied not only to an image recording apparatus but also to a sheet material feeding device in which sheet groups moved generally in a plurality of rows are aligned into a desired number of rows.

Figure 4:
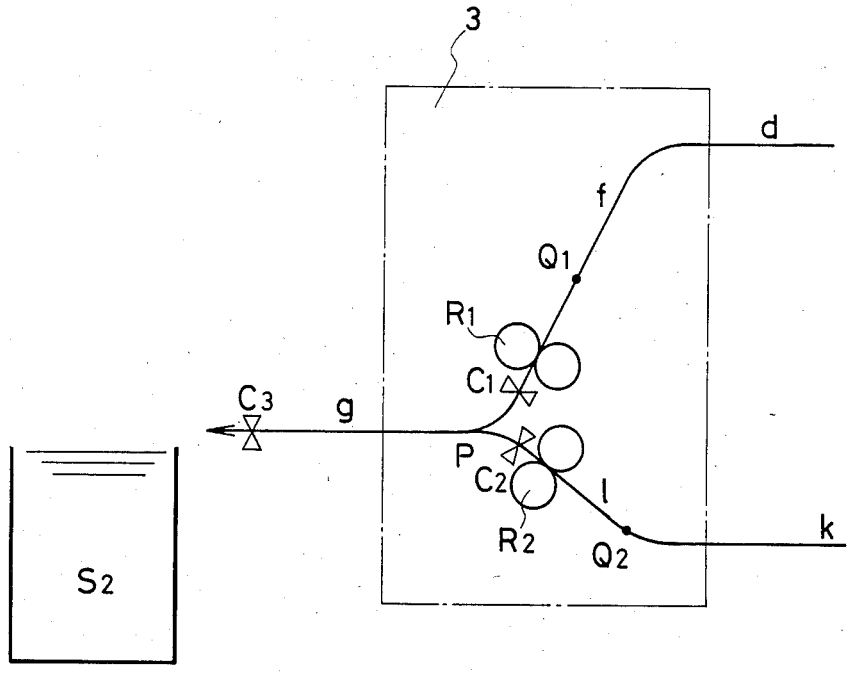
FIG. 4 is a detailed view of a discharge control portion 3.
Figure 5:
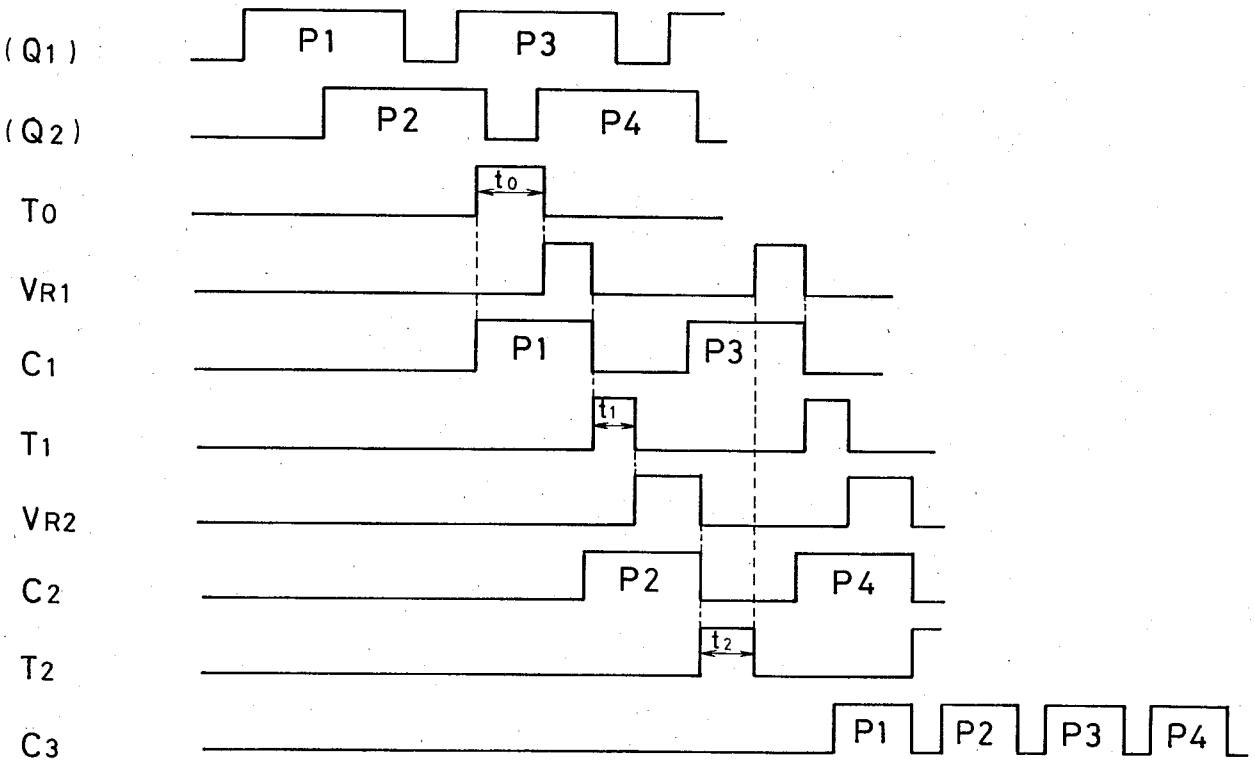
FIG. 5 is a timing chart in the discharge control portion 3.

The sequence of the present invention will now be described. FIG. 4 is a detailed view of the discharge control portion 3, and FIG. 5 is a timing chart showing the sequence in the discharge control portion 3. The sequence will hereinafter be described in detail by reference to FIGS. 4 and 5.

In FIG. 4, $\theta 1$ and $\theta 2$ designate imaginary positions equidistant from the junction P, C1 denotes a paper sensor disposed immediately behind the pair of accelerating rollers R1, C2 designates a paper sensor disposed immediately behind the pair of accelerating rollers R2, and C3 denotes a paper sensor disposed at the discharge port of the path g. The sensor outputs in a case where it is assumed that the paper sensors are disposed at the imaginary points $\theta 1$ and $\theta 2$ are ($\theta 1$) and ($\theta 2$) of FIG. 5. This corresponds to the time-serial sheet rows of FIG. 2 rewritten into the form of a timing chart. The finished copy P1 having passed through the point θ1 begins to be conveyed at a normal speed by the pair of accelerating rollers R1 rotating at a non-accelerated normal speed and, when the leading end edge of the paper arrives at the paper sensor C1, a timer $T_o$ starts time counting by the signal output of the sensor C1 and after the lapse of a present time $t_o$, a roller acceleration signal VR1 is put out and the pair of accelerating rollers R1 conveys the paper at an accelerated speed. When the trailing end edge of the paper passes through the paper sensor C1, the roller acceleration signal VR1 is turned off by the output of the paper sensor C1 and the accelerating rollers R1 are restored to their normal speed. On the other hand, by the turn-off of the paper sensor C1, another timer $T_1$ starts time counting and after the lapse of a present time $t_1$, an acceleration signal VR2 for accelerating the pair of accelerating rollers R2 is put out and the pair of accelerating rollers R2 convey the finished copy P2 at an accelerated speed. The finished copy P2, like the copy P1, is conveyed at a normal speed until it is accelerated. When the trailing end edge of the finished copy P2 passes through the paper sensor C2, the sensor output is turned off and by that signal, the acceleration signal VR2 is turned off and the roller speed is restored to its normal level. On the other hand, by the OFF signal of the paper sensor C2, another timer $T_2$ starts time counting and after the lapse of a preset time $t_2$, the roller acceleration signal VR1 is again put out to accelerate the pair of accelerating rollers R1 which are conveying the finished copy P3 at a normal speed. Thereafter, a similar sequence is repeated, whereby P4, P5, P6, . . . are accelerated in succession and finished copies are fed into the path g. As a result of the above-described control, the paper detection signal C3 in the paper sensor C3 becomes such as shown in FIG. 5, and the finished copies P1, P2, P3, . . . are aligned in good order at moderate intervals and conveyed. The signal of C3 of FIG. 5 corresponds to the time-serial sheet row of FIG. 3 rewritten into the form of a timing chart.

The times $t_o$, $t_1$, and $t_2$ of the timers $T_o$, $T_1$ and $T_2$, respectively, are determined by the positions of R1, C1, P, R2 and C2 and the values of the accelerated speeds of the rollers. The paper sensors C1 and C2 produce signals for controlling the speeds of the accelerating rollers R1 and R2 and also function as jam detecting sensors. The paper sensor C3 is a jam detecting sensor capable of detecting any jam caused in the common path.

What we claim is:

1. An image forming apparatus comprising:

a first conveyance path for conveying a sheet;

first image formation means arranged upstream of said first conveyance path for forming an image on the sheet, said first image formation means sending out the image-formed sheets one by one to said first conveyance path at a shorter interval than a length of the sheet;

a second conveyance path provided separately from said first conveyance path for conveying a sheet;

second image formation means arranged upstream of said second conveyance path for forming an image on the sheet, said second image formation means sending out the image-formed sheets one by one to said second conveyance path at a shorter interval than a length of the sheet;

a junction where said first and second conveyance paths join;

a common conveyance path for conveying downstream from said junction the sheets having passed through said first and second conveyance paths;

first accelerating means provided on said first conveyance path between said first image formation means and said junction to accelerate the sheet conveyed thereto so as to enlarge said interval between two successive sheets to a length greater than the length of the sheet for further conveyance; and second accelerating means provided on said second conveyance path between said second image formation means and said junction to accelerate the sheet conveyed thereto so as to enlarge said interval between two successive sheets to a length greater than the length of the sheet for further conveyance;

said sheets conveyed through said first and said second conveyance paths being alternately passed through said junction to be further conveyed through said common conveyance path in such a manner that the sheet conveyed through one of said first and second conveyance paths is located between two successive sheets conveyed through the other of said first and second conveyance paths.

2. An image forming apparatus according to claim 1, wherein said first and second accelerating means may convey the sheet at a plurality of speeds.

3. An image forming apparatus according to claim 2, further comprising a first sheet detecting means for detecting the sheet in said first conveyance path to generate a signal for timing the start of acceleration of said second accelerating means, and a second sheet detecting means for detecting the sheet in said second conveyance path to generate a signal for timing the start of acceleration of said first accelerating means.

4. An image forming apparatus according to claim 3, wherein said first sheet detecting means is interposed between said first accelerating means of said first conveyance path and said junction, and said second sheet detecting means is interposed between said second accelerating means of said second conveyance path and said junction.

5. An image forming apparatus according to claim 4, wherein said first and second sheet detecting means may detect jam of sheets in said first and second conveyance paths, respectively.

* * * * *